US006481072B1

(12) United States Patent
Hoover et al.

(10) Patent No.: US 6,481,072 B1
(45) Date of Patent: Nov. 19, 2002

(54) APPARATUS FOR GUIDING AND TEXTURIZING YARN AND ASSOCIATED METHODS

(75) Inventors: Donald Lynn Hoover, Cramerton, NC (US); Danny Lockman, Belmont, NC (US)

(73) Assignee: American Linc Corporation, Gastonia, NC (US)

( * ) Notice: Subject to any disclaimer, the term of this patent is extended or adjusted under 35 U.S.C. 154(b) by 99 days.

(21) Appl. No.: 09/693,430

(22) Filed: Oct. 20, 2000

(51) Int. Cl.[7] ..... D02G 1/12
(52) U.S. Cl. ..... 28/263; 28/268
(58) Field of Search ..... 28/221, 263, 268, 28/267, 271, 240, 245, 247, 258, 264, 272; 226/97.1, 97.4; 242/615, 615.11, 615.3

(56) References Cited

U.S. PATENT DOCUMENTS

| | | | | | |
|---|---|---|---|---|---|
| 3,067,480 | A | * | 12/1962 | Cocker | 19/66 R |
| 3,164,882 | A | | 1/1965 | Rosenstein et al. | 28/1 |
| 3,218,675 | A | | 11/1965 | Hendrix | 19/66 |
| 3,324,526 | A | * | 6/1967 | Burns et al. | 28/271 |
| 3,340,585 | A | | 9/1967 | Buckley et al. | 28/1 |
| 3,505,155 | A | * | 4/1970 | Balch et al. | 28/268 |
| 3,553,802 | A | * | 1/1971 | Stanley | 28/268 |
| 3,636,599 | A | | 1/1972 | Stanley | 28/1.6 |
| 3,707,299 | A | | 12/1972 | Trifunovic | 28/1.6 |
| 3,813,740 | A | | 6/1974 | Heijnis | 28/1.6 |
| 3,835,513 | A | | 9/1974 | Stanley | 28/72.14 |
| 4,043,009 | A | * | 8/1977 | Stanley et al. | 28/221 |
| 5,020,198 | A | | 6/1991 | Hill et al. | 28/250 |
| 5,025,538 | A | * | 6/1991 | Saleh | 28/263 |
| 5,675,878 | A | * | 10/1997 | Brown et al. | 28/172.2 |
| 6,079,086 | A | * | 6/2000 | Wirz | 28/240 |
| 6,094,790 | A | * | 8/2000 | Weiss | 28/221 |
| 6,134,758 | A | * | 10/2000 | Raskin et al. | 28/263 |
| 6,199,250 | B1 | * | 3/2001 | Ballarati | 28/271 |
| 6,223,783 | B1 | * | 5/2001 | Peeters et al. | 28/271 |

* cited by examiner

*Primary Examiner*—Amy B. Vanatta
(74) *Attorney, Agent, or Firm*—Bracewell & Patterson, LLP

(57) ABSTRACT

A yarn guiding and texturizing apparatus and methods are provided. The apparatus preferably includes a yarn supply positioned to supply a plurality of yarn strands and a yarn guide positioned downstream from the yarn supply to receive the plurality of yarn strands in a position substantially parallel and spaced-apart from each other and to guide the plurality of yarns downstream along a path of travel. The apparatus also preferably includes a plurality of draw rolls positioned downstream from and adjacent the yarn guide for drawing the plurality of yarn strands from the yarn supply and through the yarn guide, a yarn stuffer box positioned downstream from and adjacent the plurality of draw rolls to receive the plurality of yarn strands therein and to texturize the plurality of yarn strands, and a conveyor positioned downstream from the stuffer box to receive the plurality of texturized yarn strands thereon and to convey the texturized yarn therefrom.

15 Claims, 7 Drawing Sheets

20
50
40
41
30
42
26
60
CONVEYOR
60
STUFFER BOX
50
YARN GUIDE
30
P
5
25
5
5
5
5
21
22
22
23
YARN SUPPLY
21
15
TO TAKE UP SPOOLS
18
17
17
COOLING CONVEYOR
16
16
HEAT SETTING OVEN

TO ROLLERS
COMPRESSED AIR
FLUID PRESSURE SOURCE
SUCTION
P
P
10
10
30
31
32
33
34
35
36
38
40
41
42
45
50
51
53
54
55
56
S

APPARATUS FOR GUIDING AND TEXTURIZING YARN AND ASSOCIATED METHODS

FIELD OF THE INVENTION

The present invention relates to the field of textiles and, more particularly, to the textile handling, texturizing, or manufacturing industries.

BACKGROUND OF THE INVENTION

In the textile industry, handling and texturizing yarn for numerous applications can be quite important. Various systems have been developed for handling yarn which include virtual twisters such as shown in U.S. Pat. No. 5,775,079 titled "Apparatus For Imparting Virtual Twist To Strand Material And Method Of Imparting Same" by Hoover, one of the co-inventors of the present application and also having the common assignee as the present application. Yarn stuffer boxes and yarn coilers have also been developed to assist in the process of texturizing yarn by forming crimps or undulations in the yarn with the use of a conveyor belt passing the crimped or undulations in the yarn through a heat oven. An example of such a coiler can be seen in U.S. Pat. No. 5,483,730 titled "Apparatus And Method For Forming Coils Of Yarn And For Heat Setting Same" also by Hoover and also having the common assignee as the present application.

Other conventional stuffer boxes have been used for texturizing yarn in many applications. To increase capacity or to provide alternative paths of yarn so that if one line is down all of the lines are not down a plurality of substantially parallel rows of stuffer boxes have been used. Examples of such lines of the prior art can be seen in FIGS. 2 and 4. These systems, however, require a large amount of space, increase floor footprints for machinery, and provide a relatively slow output for the yarn. Accordingly, there is still a need for systems and devices which further increase the capacity, speed, and otherwise enhance the handling and texturizing of yarn.

SUMMARY OF THE INVENTION

With the foregoing in mind, the present invention advantageously provides an apparatus and methods for guiding and texturizing yarn more quickly and efficiently. The present invention also advantageously provides an apparatus and methods for guiding and texturizing yarn having a plurality of different textures either in the same yarn strands or different yarn strands. The present invention additionally advantageously provides an apparatus and methods for guiding and texturizing yarn which allows for easy and flexible handling of the yarn. The present invention further advantageously provides an apparatus and methods for guiding and texturizing yarn which substantially reduces tangling of yarn in a yarn texturizing or handling system.

More particularly, the apparatus preferably includes a yarn supply positioned to supply a plurality of yarn strands and a yarn guide positioned downstream from the yarn supply to receive the plurality of yarn strands in a position substantially parallel and spaced-apart from each other and to guide the plurality of yarns downstream along a path of travel. The apparatus also preferably includes a plurality of draw rolls positioned downstream from and adjacent the yarn guide for drawing the plurality of yarn strands from the yarn supply and through the yarn guide, a yarn stuffer box positioned downstream from and adjacent the plurality of draw rolls to receive the plurality of yarn strands therein and to texturize the plurality of yarn strands, and a conveyor positioned downstream from the stuffer box to receive the plurality of texturized yarn strands thereon and to convey the texturized yarn therefrom.

The present invention also provides a yarn guide having a guide body and a plurality of spaced-apart openings formed in the guide body and extending from a proximal end to a distal end of the guide body, each of the plurality of openings extend through the guide body substantially parallel to each other. The yarn can also advantageously include a fluid pressure source and fluid pressure conduits in fluid communication with the fluid pressure source and the guide body for supplying either positive or negative fluid pressure to the guide body.

The present invention additionally provides a yarn texturizing device including a frame, a pair of draw rolls connected to the frame, and a stuffer box connected to the frame. The stuffer box preferably has an elongate opening thereof positioned closely adjacent the pair of draw rolls and extending lengthwise along a nip region of the draw rolls to enhance receiving a plurality of yarn strands when traveling through the draw rolls. The device also preferably has a texturizing controller associated with the stuffer box for providing a first type of texture to the plurality of yarn strands when in one position and a second different type of texture to the plurality of yarn strands when in a second position.

The present invention further provides a method of texturizing a plurality of yarn strands. The method preferably includes guiding a plurality of yarn strands substantially parallel and spaced-apart from each other along a path of travel into a common stuffer box, accumulating the plurality of yarn strands in the common stuffer box, and periodically opening a door of the stuffer box responsive to pressure on the door from the accumulated plurality of yarn strands to thereby release the accumulated yarn from the stuffer box. The method can also include providing a first texture type in a plurality of yarn strands and providing a second different texture type in a plurality of yarn strands.

Another method of guiding yarn to a texturizing device is provided which preferably includes drawing a plurality of spaced-apart yarn strands to a common texturizing device and guiding the plurality of spaced-apart yarn strands to extend substantially parallel to each other. The method can also include supplying fluid pressure to assist in drawing the plurality of yarn strands to the common texturizing device.

BRIEF DESCRIPTION OF THE DRAWINGS

Some of the features, advantages, and benefits of the present invention having been stated, others will become apparent as the description proceeds when taken in conjunction with the accompanying drawings in which.

DETAILED DESCRIPTION OF PREFERRED EMBODIMENTS

The present invention will now be described more fully hereinafter with reference to the accompanying drawings which illustrate preferred embodiments of the invention. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, the prime notation, if used, indicates similar elements in alternative embodiments.

Figure 1:
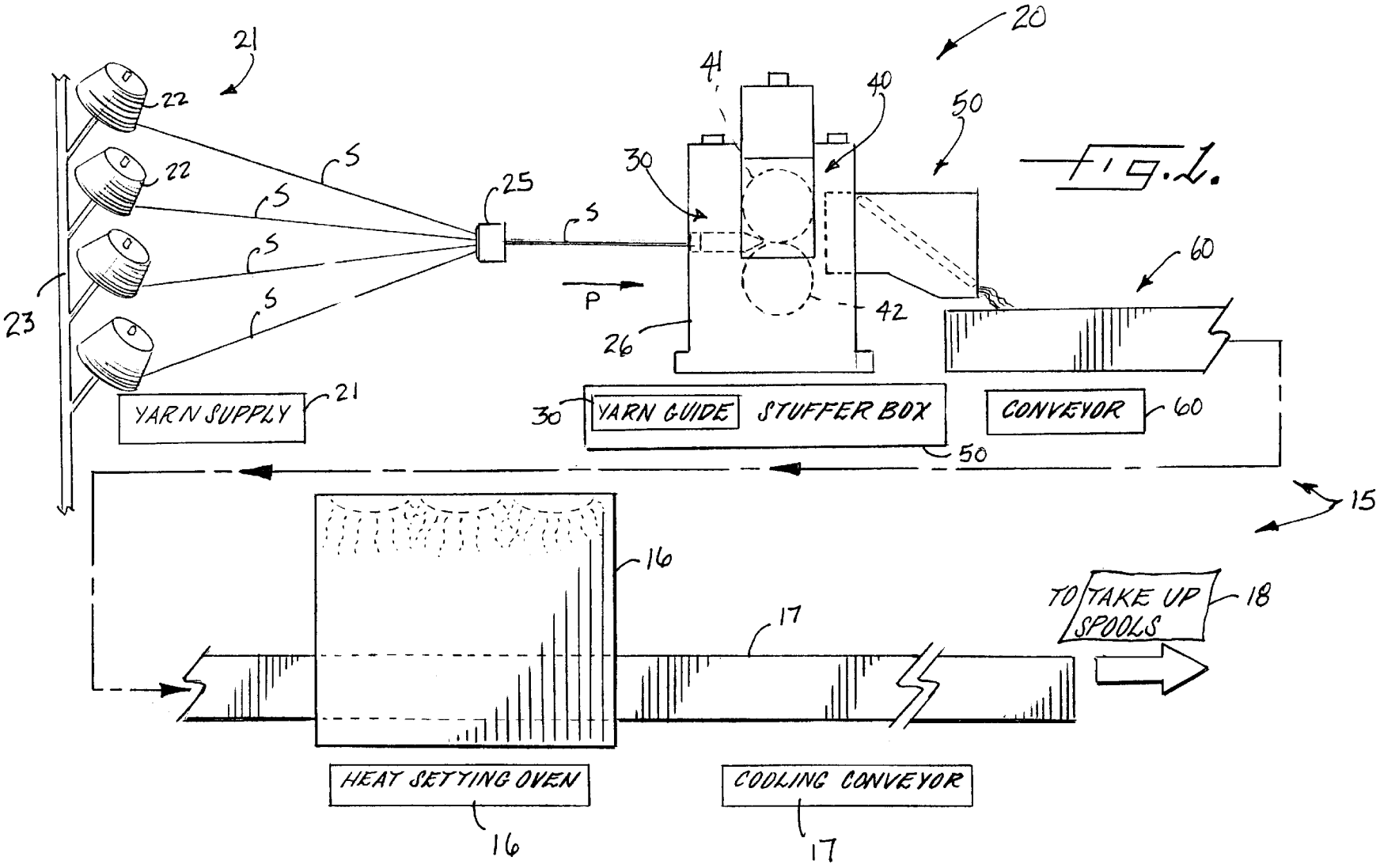
FIG. 1 is a schematic environmental view of a system for handling yarn according to the present invention.
Figure 2:
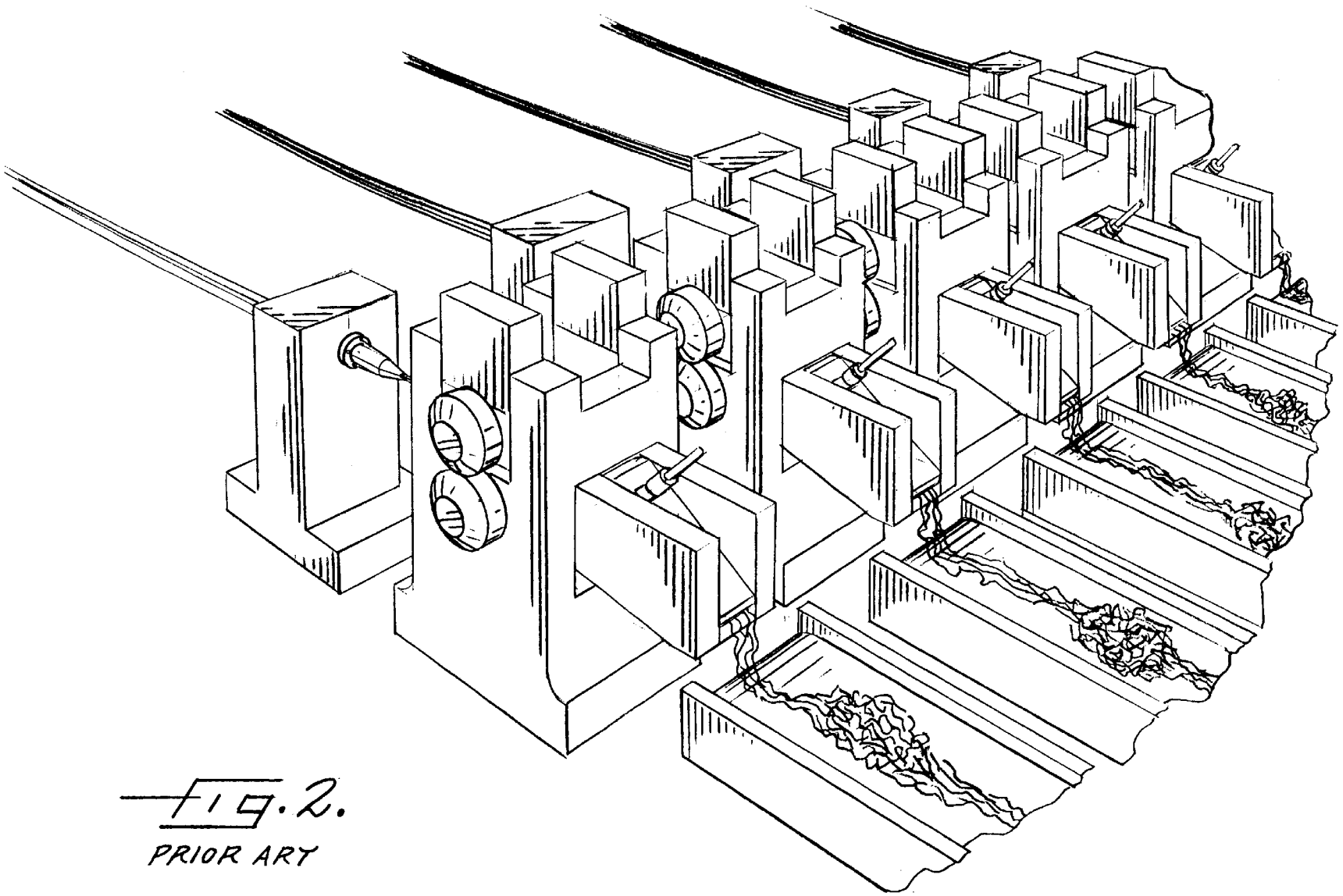
FIG. 2. PRIOR ART
FIG. 2 is a perspective view of a plurality of yarn stuffer boxes of a system for handling yarn with each box having a false twisting device positioned upstream therefrom according to the prior art.
Figure 3:
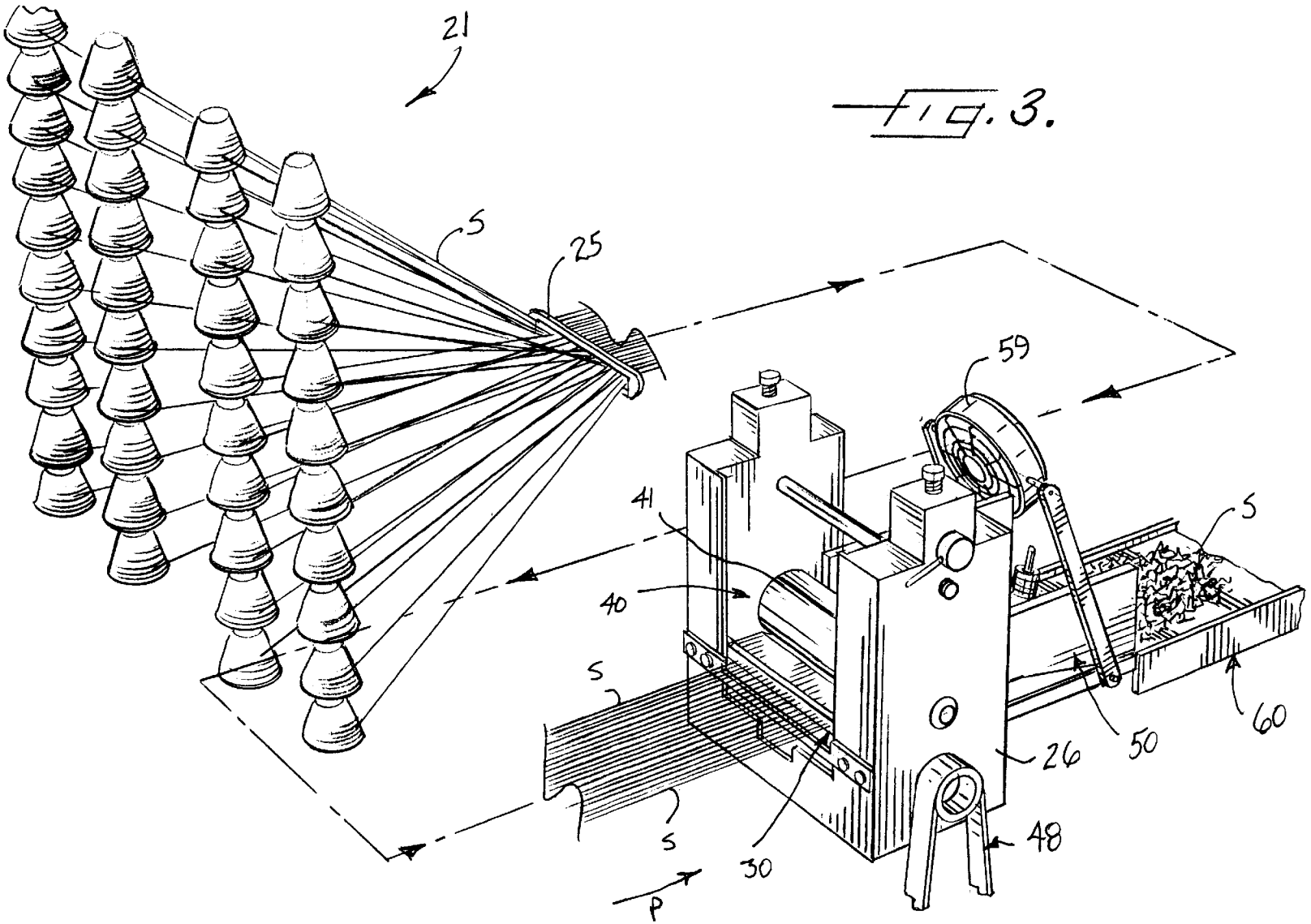
FIG. 3 is a perspective view of an apparatus for guiding and texturizing yarn according to the present invention.

FIGS. 1 and 3 illustrate a yarn guiding and texturizing apparatus 20 according to the present invention. As understood by those skilled in the art, a yarn guiding and texturizing apparatus 20 can form part of a yarn handling or texturizing system 15 which can include a heat setting oven 16, a cooling conveyor 17, and a yarn take-up 18 such as provided by take-up spools or other take up devices as shown in FIG. 1. The apparatus 20 preferably has a yarn supply 21 positioned to supply a plurality of yarn strands S. The yarn supply 21, for example, can include a plurality of yarn spools 22 mounted on a tree or a creel 23. A yarn guide 30 is preferably positioned downstream from the yarn supply 21 to receive the plurality of yarn strands S in a position substantially parallel and spaced-apart from each other and to guide the plurality of yarns downstream along a path of travel P. The plurality of yarn strands enter the yarn guide 30 positioned spaced-apart and substantially parallel to each other along a path of travel and exit the yarn guide 30 positioned spaced-apart and substantially parallel to each other along the same path of travel P. Although the yarn guide 30 will be referenced substantially herein as the yarn guide 30, the yarn guide 30 can be a first yarn guide, and the apparatus 20 can further include a second yarn guide 25 positioned downstream from the yarn supply 21 and upstream from the first yarn guide 30 to assist in guiding the plurality of yarn strands S to the first yarn guide 30 (see FIGS. 1–3). As understood by those skilled in the art, the position, size, and shape of the second yarn guide 25 can also assist in handling tension in the strands extending to the first yarn guide 30. The apparatus 20 further preferably has a plurality of draw rolls 40 positioned downstream from and adjacent the first yarn guide 30 for drawing the plurality of yarn strands from the yarn supply 21 and through the first yarn guide 30 (as well as the second yarn guide 25). The draw rolls are preferably being driven by a drive assembly 48 which includes a drive motor (not shown) as understood by those skilled in the art. A yarn stuffer box 50 is preferably positioned downstream from and adjacent the plurality of draw rolls 40 to receive the plurality of yarn strands S therein and to texturize the plurality of yarn strands due to accumulation within a compact space as understood by those skilled in the art. A conveyor 60 is preferably positioned downstream from the stuffer box 50 to receive the plurality of texturized yarn strands thereon and to convey the texturized yarn therefrom to the heat setting oven 16 or other areas downstream as desired. A fan 59 can also be used to cool the rolls 40 and/or yarn strands S as shown.

Figure 5:
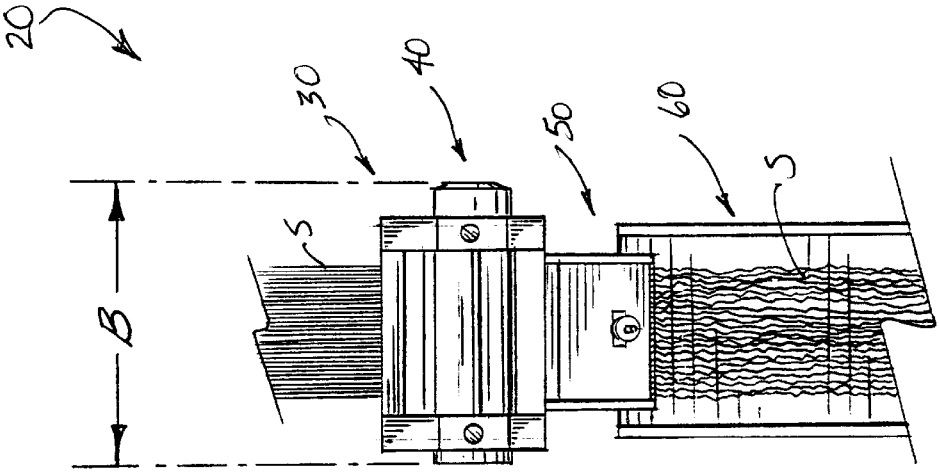
FIG. 5 is a top plan view of an apparatus for guiding and texturizing yarn according to the present invention.
Figure 4:
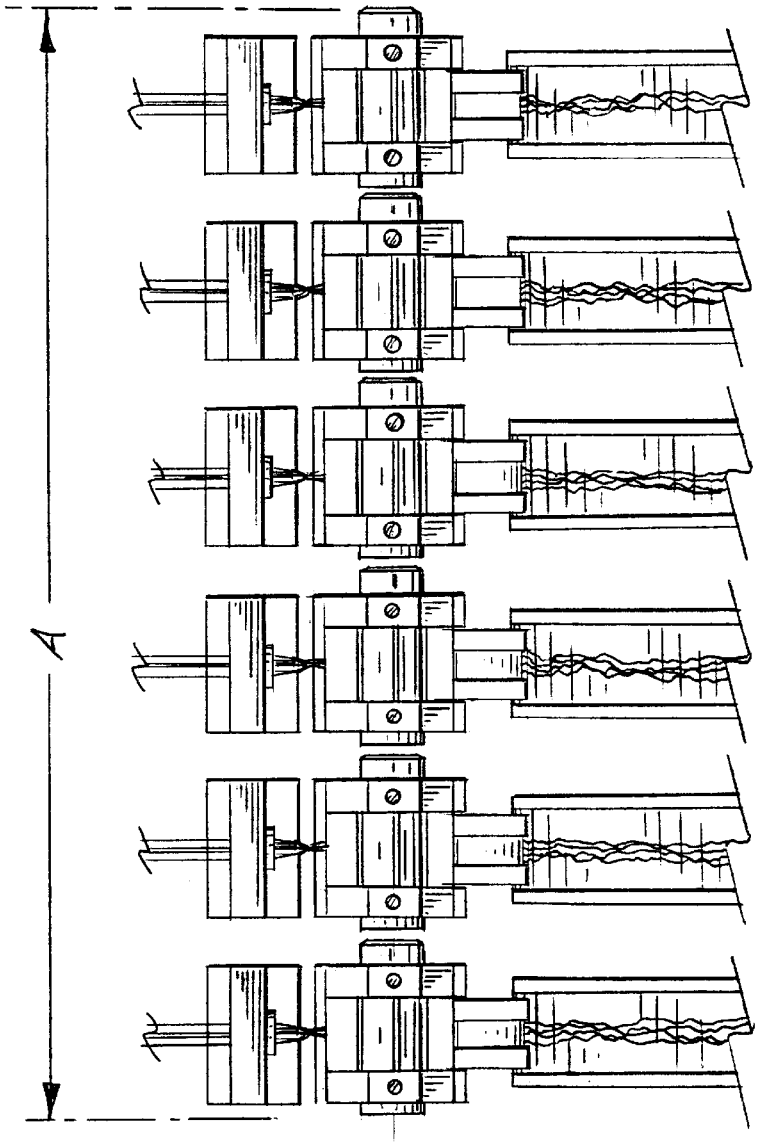
FIG. 4. PRIOR ART
FIG. 4 is a top plan view of a plurality of yarn stuffer boxes of a system for handling yarn with each box having a false twisting device positioned upstream therefrom according to the prior art.
Figure 6:
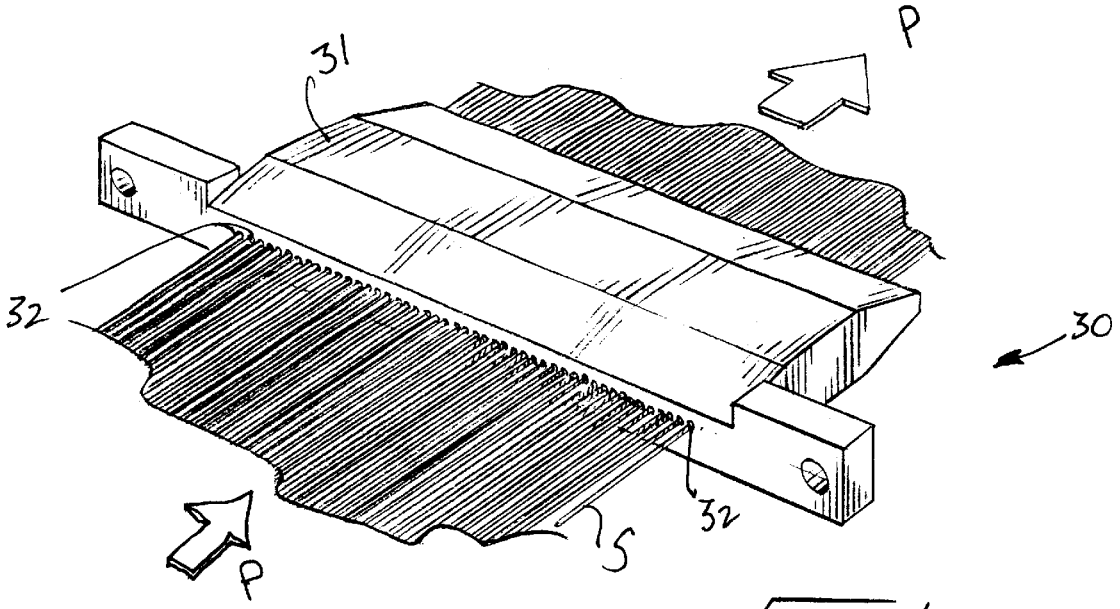
FIG. 6 is a perspective view of a yarn guide of an apparatus for guiding and texturizing yarn according to the present invention.

By providing an enlarged stuffer box 50, an enlarged pair of draw rolls 40, and a yarn guide 30 which receives a plurality of spaced-apart and substantially parallel yarn strands as compared to the prior art shown in FIGS. 2 and 4, the apparatus 30 takes up substantially less space B as compared to the space A for an equal amount of strands run on separate lines (see FIGS. 4–5). For example, the apparatus 20 can handle 2 to 60 or more strands, e.g., 40–50, passing through the yarn guide 30 and advantageously allows each strand S to have a separate feed into the draw rolls 40. The apparatus 20 advantageously keeps the yarn strands more separated from each other to thereby reduce tangling and other tension problems downstream in the system 15. It will be understood by those skilled in the art that the concepts of this invention related to the yarn guide and the stuffer box can be used as well in other types of textiles systems and with other types of texturizing devices or systems.

Figure 7:
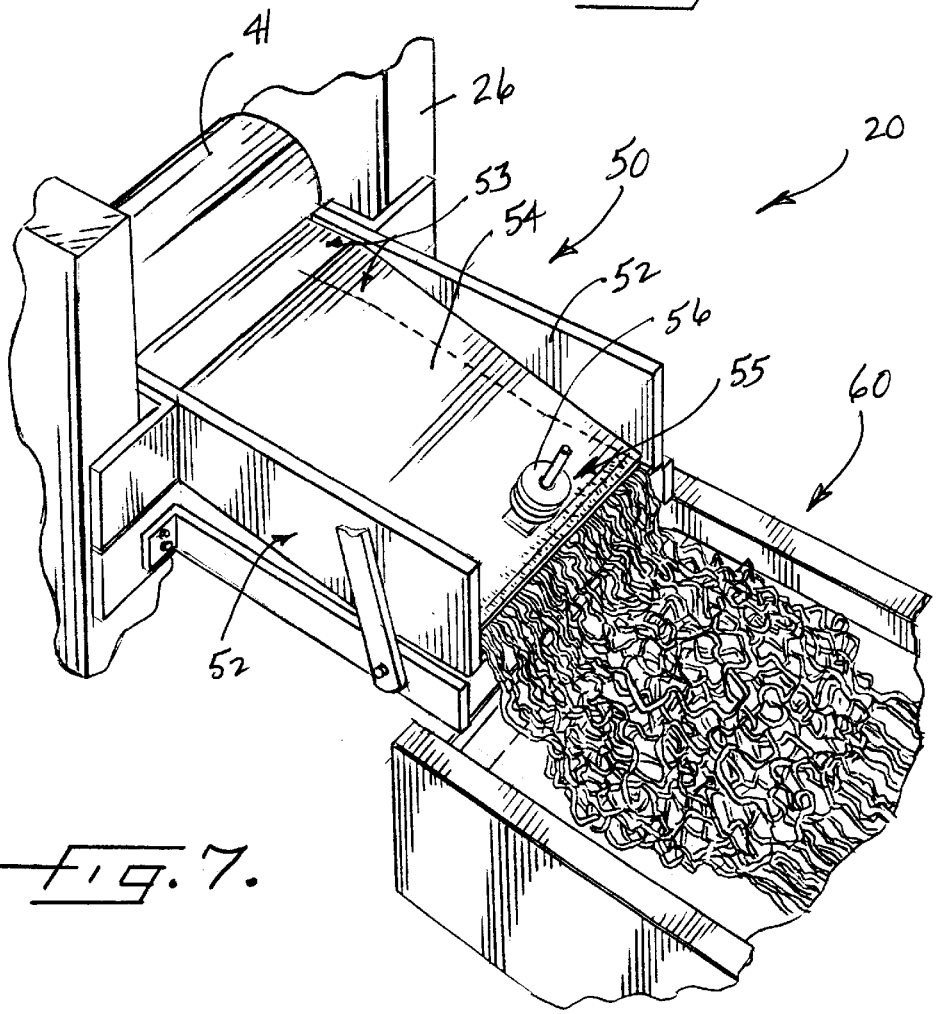
FIG. 7 is a fragmentary perspective view of a yarn texturizer of an apparatus for guiding and texturizing yarn according to the present invention.
Figures 8, 9, 10:
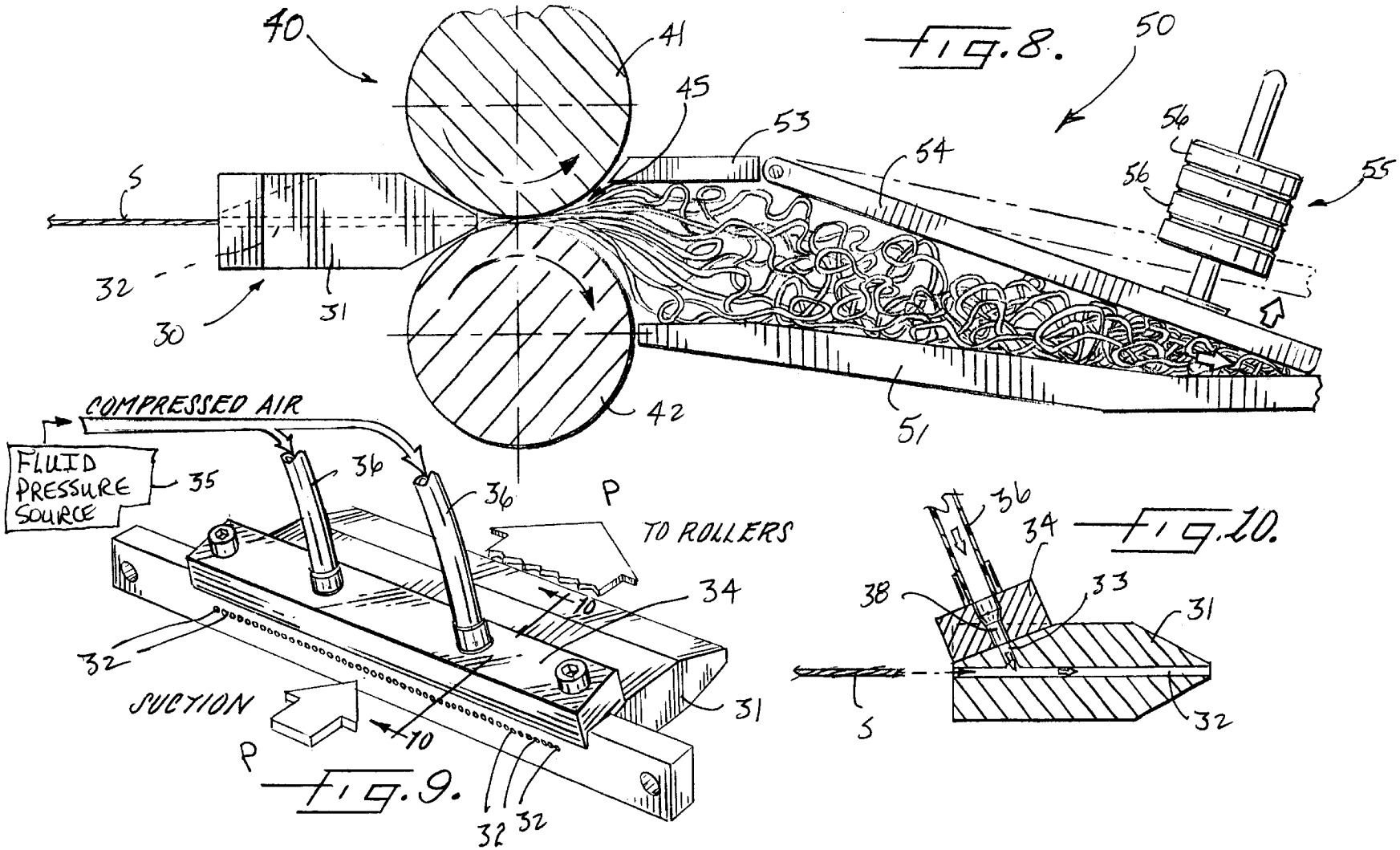
FIG. 8 is a schematic side elevational view of an apparatus for guiding and texturizing yarn according to the present invention.
FIG. 9 is a perspective view of a yarn guide of an apparatus for guiding and texturizing yarn according to the present invention.
FIG. 10 is a sectional view of a yarn guide of an apparatus for guiding and texturizing yarn taken along line 10—10 of FIG. 9 according to the present invention.
Figure 12:
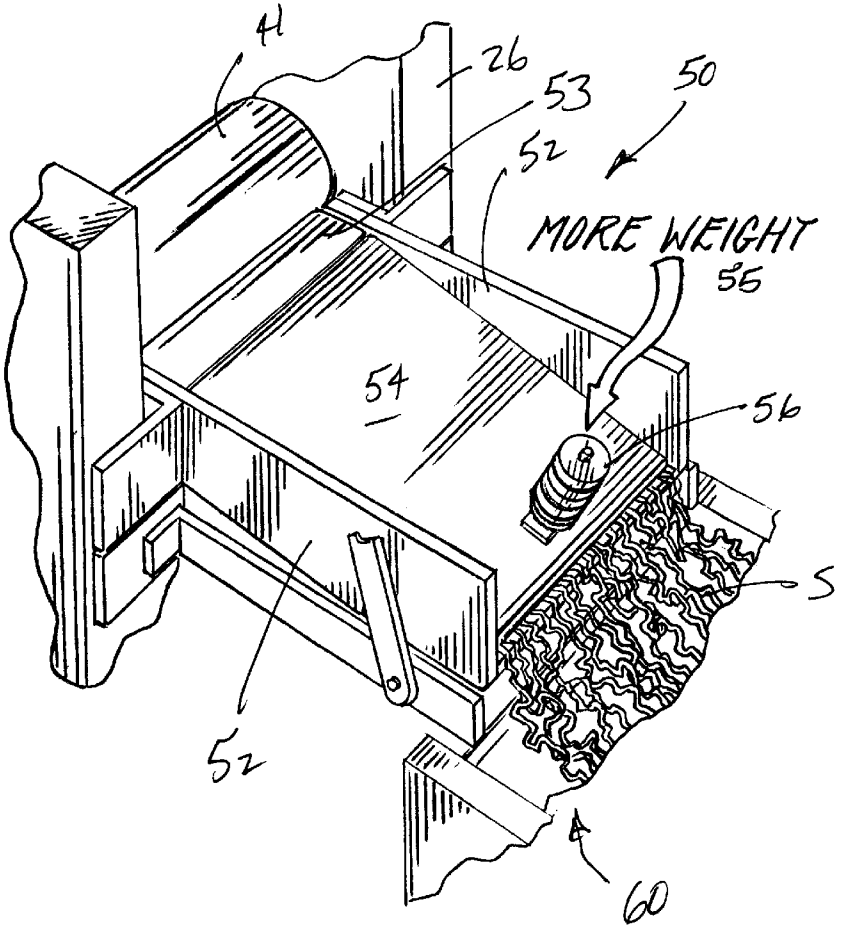
FIG. 12 is a fragmentary perspective view of a yarn texturizer having a texturizing controller in a second position to provide a second texture type in the yarn of an apparatus for guiding and texturizing yarn according to the present invention.
Figure 11:
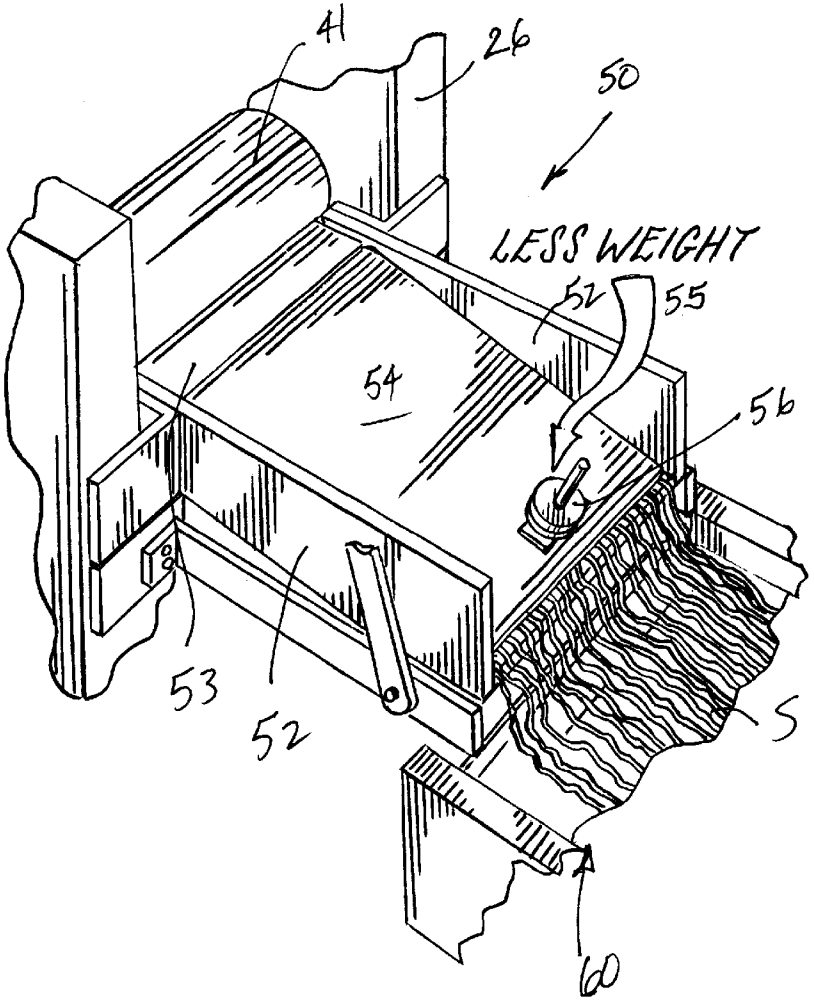
FIG. 11 is a fragmentary perspective view of a yarn texturizer having a texturizing controller in a first position to provide a first texture type in the yarn of an apparatus for guiding and texturizing yarn according to the present invention.

As perhaps best shown in FIGS. 7–8, the yarn stuffer box 50 is preferably constructed similar to other conventional stuffer boxes as understood by those skilled in the art and as shown in the drawings, but is preferably substantially larger than conventional stuffer boxes which only receive a relatively small number of strands at a time therethrough (see FIG. 4). The stuffer box 50, for example, preferably has a bottom 51, a plurality of side walls 52, and a top 53 as shown. The top can include a movable door 54 or a door/panel pivotally mounted to open and close responsive to pressure on inner surfaces of the door. The stuffer box 50 preferably has a yarn texturizing controller 55 associated therewith for providing a first type of texture to the yarn when in one position and a second different type of texture to the yarn when in a second position (see FIGS. 11–12). The stuffer box 50 includes a movable door 54, as understood by those skilled in the art, which periodically opens to allow the plurality of texturized yarn strands to travel from the stuffer box 50 and be deposited onto the conveyor 60 responsive to pressure from a selected amount of the plurality of yarn strands positioned within the stuffer box 50. The yarn texturizing controller 55 is preferably connected to the movable door 54 and uses preselected amounts of weight such as individual annular-shaped bars 56 or other weights on the door 54 to responsively resist opening of the movable door 54 and thereby provide the first and second different yarn textures (see FIGS. 11–12).

The apparatus 20 also can include a mounting frame 26 and the pair of draw rolls 40 can be connected to the mounting frame 26 (see FIG. 7). The stuffer box 50 is also preferably connected to the mounting frame 26 and positioned closely adjacent a downstream side of the pair of draw rolls 40 so that an elongate opening 58 in the stuffer box extending lengthwise along an output nip region 45 between the draw rolls 41, 42 readily receives the plurality of yarn strands S therein.

As perhaps best shown in FIGS. 8–10, the yarn guide 30 (or first yarn guide) preferably includes a guide body 31 having a plurality of spaced-apart openings 32 formed therein. Each of the plurality of spaced-apart openings 32 extends from a proximal end to a distal end of the guide body 31 and extends substantially parallel to each other. The yarn guide 30 further includes a fluid pressure source 35 and fluid pressure conduits 36 in fluid communication with the fluid pressure source 35 and the guide body 31 for supplying either positive or negative fluid pressure to the guide body 31. The fluid pressure source 35 is preferably provided by a compressed air source which supplies compressed air to the guide body. The guide body 31 also includes a plurality of body conduits 33 positioned in fluid communication with each of the plurality of openings 32 so that the compressed air is of a pressure so as to assist in drawing the plurality of yarn strands through the openings and to the stuffer box. The guide body 31 can also include an air transfer manifold 34 connected to the fluid pressure conduits 36 which has a channel 38 or other conduit which allows the air to travel to the body conduits 33 and to the openings 32 (see FIGS. 9–10). Also, as shown, the distal end of the guide body 31 can advantageously have converging upper and lower outer surfaces to enhance positioning of the yarn guide 30 closely adjacent the pair of draw rolls 41, 42.

As shown in FIGS. 1–12 and as described above, the present invention further provides a method of texturizing a plurality of yarn strands S. The method preferably includes guiding a plurality of yarn strands substantially parallel and spaced-apart from each other along a path of travel into a common stuffer box 50, accumulating the plurality of yarn strands in the common stuffer box 50, and periodically opening a door 54 of the stuffer box 50 responsive to pressure on the door from the accumulated plurality of yarn strands to thereby release the accumulated yarn from the stuffer box 50. The method can also include providing a first texture type in a plurality of yarn strands and providing a second different texture type in a plurality of yarn strands.

Another method of guiding yarn to a texturizing device is provided which preferably includes drawing a plurality of spaced-apart yarn strands S to a common texturizing device 50 and guiding the plurality of spaced-apart yarn strands S to extend substantially parallel to each other. The method can also include supplying fluid pressure to assist in drawing the plurality of yarn strands S to the common texturizing device 50.

In the drawings and specification, there have been disclosed a typical preferred embodiment of the invention, and although specific terms are employed, the terms are used in a descriptive sense only and not for purposes of limitation. The invention has been described in considerable detail with specific reference to these illustrated embodiments. It will be apparent, however, that various modifications and changes can be made within the spirit and scope of the invention as described in the foregoing specification and as defined in the appended claims.

What is claimed is:

1. A yarn guiding and texturizing apparatus comprising:

a yarn supply positioned to supply a plurality of yarn strands;

a yarn guide positioned downstream from the yarn supply to receive the plurality of yarn strands in a position substantially parallel and spaced-apart from each other and to guide the plurality of yarn strands downstream along a path of travel;

a plurality of draw rolls positioned downstream from and adjacent the yarn guide for drawing the plurality of yarn strands from the yarn supply and through the yarn guide;

a yarn stuffer box positioned downstream from and adjacent the plurality of draw rolls to receive the plurality of yarn strands therein and to texturize the plurality of yarn strands, the yarn stuffer box including an elongate opening extending lengthwise along a nip region among the draw rolls to readily receive the plurality of yarn strands;

a mounting frame connected to the plurality of draw rolls and the yarn stuffer box so that the yarn stuffer box is closely positioned adjacent a downstream side of the plurality of draw rolls;

a guide body having a plurality of spaced-apart openings formed therein extending from a proximal end to a distal end of the guide body and extending substantially parallel to each other;

a fluid pressure source in fluid communication with the guide body to supply fluid pressure to the guide body; and a conveyor positioned downstream from the yarn stuffer box to receive the plurality of texturized yarn strands thereon and to convey the texturized yarn therefrom.

2. An apparatus as defined in claim 1, wherein yarn stuffer box has a yarn texturizing controller associated therewith for providing a first type of texture to the yarn when in one position and a second different type of texture to the yarn when in a second position.

3. An apparatus as defined in claim 2, wherein the stuffer box includes a movable door which periodically opens to allow the plurality of texturized yarn strands to travel from the stuffer box and be deposited onto a conveyor responsive to pressure from a selected amount of the plurality of yarn strands positioned within the stuffer box, and wherein the yarn texturizing controller is connected to the movable door and uses preselected amounts of weight on the door to responsively resist opening of the movable door and thereby provide the first and second different yarn textures.

4. An apparatus as defined in claim 1, wherein the pressure source comprises compressed air, wherein the guide body includes a plurality of body conduits positioned in fluid communication with each of the plurality of openings, and wherein the compressed air is of a pressure so as to assist in drawing the plurality of yarn strands through the openings and to the stuffer box.

5. An apparatus as defined in claim 4, wherein the distal end of the guide body has converging upper and lower outer surfaces to enhance positioning of the yarn guide closely adjacent the pair of draw rolls.

6. An apparatus as defined in claim 1, wherein the plurality of yarn strands enter the yarn guide positioned spaced-apart and substantially parallel to each other along a path of travel and exit the yarn guide positioned spaced-apart and substantially parallel to each other along the same path of travel.

7. An apparatus as defined in claim 6, wherein the yarn guide comprises a first yarn guide, and the apparatus further comprising a second yarn guide positioned downstream from the yarn supply and upstream from the first yarn guide to assist in guiding the plurality of yarn strands to the first yarn guide.

8. A yarn guide comprising:

a guide body having converging upper and lower outer surfaces of the guide body to enhance positioning of the yarn guide closely adjacent at least one draw roll;

a plurality of spaced-apart openings formed in the guide body and extending from a proximal end to a distal end of the guide body, each of the plurality of openings extend through the guide body substantially parallel to each other; and a fluid pressure source in fluid communication with the guide body to supply fluid pressure to the guide body.

9. A yarn guide as defined in claim 8, wherein the pressure source comprises compressed air, wherein the guide body includes a plurality of body conduits positioned in fluid communication with each of the plurality of openings, and wherein the compressed air is of a pressure so as to assist in drawing a plurality of yarn strands through the openings and away therefrom.

10. A yarn guide as defined in claim 8, wherein a plurality of yarn strands when passing through the guide body enter the guide body positioned spaced-apart and substantially parallel to each other along a path of travel and exit the guide body positioned spaced-apart and substantially parallel to each other along the same path of travel.

11. A yam texturizing device comprising:

a frame;

a plurality of draw rolls connected to the frame;

a stuffer box device connected to the frame, having an elongate opening thereof positioned closely adjacent the plurality of draw rolls and extending lengthwise along a nip region of the draw rolls to enhance receiving a plurality of yarn strands when traveling through the draw rolls;

a texturizing controller associated with the stuffer box for providing a first type of texture to the plurality of yarn strands when in one position and a second different type of texture to the plurality of yam strands when in a second position; and a fluid pressure source adjacent the yam texturizing device and in fluid communication with the guide body to supply fluid pressure to the guide body.

12. A device as defined in claim 11, wherein the stuffer box includes a movable door which periodically opens to allow the plurality of texturized yarn strands to travel from the stuffer box and be deposited onto a conveyor responsive to pressure from a selected amount of the plurality of yarn strands positioned within the stuffer box, and wherein the yarn texturizing controller is connected to the movable door and uses preselected amounts of weight on the door to responsively resist opening of the movable door and thereby provide the first and second different yarn textures.

13. A method of texturizing a plurality of yam strands, the method comprising:

guiding a plurality of yam strands substantially spaced-apart from each other along a path of travel into a common stuffer box;

accumulating the plurality of yam strands in the common stuffer box adjacent a fluid pressure source in fluid communication with a guide body; and periodically opening a door of the stuffer box responsive to pressure on the door from the accumulated plurality of yam strands to thereby release the accumulated yarn from the stuffer box.

14. A method as defined in claim 13, further comprising providing a first texture type in a plurality of yarn strands and providing a second different texture type in a plurality of yarn strands.

15. A method of guiding yam to a texturizing device, the method comprising:

drawing a plurality of spaced-apart yam strands to a common texturizing device;

guiding the plurality of spaced-apart yarn stands to extend substantially parallel to each other; and supplying a fluid pressure to assist in drawing the plurality of yarn strands to the common texturizing device.

* * * * *

UNITED STATES PATENT AND TRADEMARK OFFICE

CERTIFICATE OF CORRECTION

PATENT NO. : 6,481,072 B1
DATED : November 19, 2002
INVENTOR(S) : Hoover et al.

It is certified that error appears in the above-identified patent and that said Letters Patent is hereby corrected as shown below:

Column 7,
Line 31, delete “yam” and insert -- yarn -- therefor; and

Column 8,
Lines 1, 3, 16, 18, 21, 26, 32 and 34, delete “yam” and insert -- yarn -- therefor.

Signed and Sealed this

Eleventh Day of March, 2003

JAMES E. ROGAN
*Director of the United States Patent and Trademark Office*